United States Patent [19]

Silva

[11] Patent Number: 4,834,782

[45] Date of Patent: May 30, 1989

[54] SYSTEM AND METHOD FOR SCRUBBING ONE FLUID WITH ANOTHER FLUID

[76] Inventor: Robert E. Silva, 6452 N. 8th St., Fresno, Calif. 93710

[21] Appl. No.: 180,538

[22] Filed: Apr. 12, 1988

Related U.S. Application Data

[63] Continuation-in-part of Ser. No. 887,727, Jul. 21, 1986, abandoned.

[51] Int. Cl.[4] ..... B01F 3/00

[52] U.S. Cl. ..... 55/93; 55/223; 55/224; 55/225; 55/343; 137/563; 137/599; 210/199; 210/205; 210/206; 261/21; 261/76; 261/DIG. 54; 366/136; 366/137; 366/197; 422/170; 422/189; 422/196; 422/220

[58] Field of Search ..... 422/170, 189, 196, 225, 422/220, 234; 261/21, 22, 23, 76, DIG. 54; 137/563, 599; 210/738, 198.1, 199, 205, 206; 366/136, 137, 197, 198, 317; 55/223–225, 85, 86, 91–94, 228, 343; 423/659

[56] References Cited

U.S. PATENT DOCUMENTS 3,870,082 3/1975 Holl ..... 138/40
4,375,439 3/1983 Hegemann et al. ..... 261/62

FOREIGN PATENT DOCUMENTS 44162 9/1887 Fed. Rep. of Germany ..... 261/21
30162 1/1908 Fed. Rep. of Germany ... 261/DIG. 54

*Primary Examiner*—Asok Pal
*Attorney, Agent, or Firm*—Thorpe, North & Western

[57] ABSTRACT

Apparatus and methods are disclosed for intimately mixing and contacting first and second fluids for purposes of scrubbing and cleaning one of the fluids with the other. The apparatus includes a venturi mixer device having a nozzle and feed conduit for mixing two fluid streams together. In addition, the venturi mixer device has an impingement member upon which the mixed stream of fluids impinge immediately following the mixing of the streams of fluid. The venturi mixer devices are preferably arranged in a cascade arrangement with subsequent devices being spaced a vertical distance from the previous respective devices. First and second fluids are mixed together in the initial venturi mixer device. The mixed effluents from the initial and intermediate venturi mixer devices are used as the drive fluid for subsequent, respective, downstream venturi mixer devices to further mix additional second fluid to the mixed effluents. The mixed effluents from the lowermost venturi mixer devices are fed to a settling chamber wherein light and heavy components are separated from the intermediate fluid component, and the intermediate fluid component is recirculated to the initial venturi mixer device as the first fluid.

19 Claims, 3 Drawing Sheets

SYSTEM AND METHOD FOR SCRUBBING ONE FLUID WITH ANOTHER FLUID

CROSS-REFERENCE TO RELATED APPLICATION

This application is a continuation-in-part application of my copending application Ser. No. 887,727 now abandoned, filed July 21, 1986.

BACKGROUND OF THE INVENTION

1. Field of the Invention

The present invention relates to improvements in methods and in apparatus for intimately mixing a fluid which can be a liquid, a gas, or a combination thereof and can further contain finely divided solids, amorphous particulates, molecular precipitates and other finely divided matter with a second fluid which can be a liquid, a gas or a combination thereof and which can also contain added reactive chemicals or components capable of reacting with constituents of the other fluid. In particular, the invention relates to apparatus including an adjustable venturi device for mixing and emulsifying the two fluids with each other to form reactive mixtures. The invention specifically relates to apparatus and methods in which a first fluid comprising liquids, vapors and solids in a finely divided condition, can be intimately mixed with a second fluid comprising liquids, vapors and solids in a finely divided and/or molecular condition to provide the desired reactions between the components of the two joined fluids such that components of the fluids can be recovered and the cleaned fluids recovered.

Included in the invention are apparatus and methods for mixing and emulsifying the two fluid substances using adjustable venturi devices whereby the combined and emulsified fluids from one venturi device may be reused to operate a subsequent venturi device, with each venturi device developing and applying vacuum to draw additional fluid from one of the sources of the two fluids into the stream of mixed fluids. The invention in addition relates to apparatus and methods provided for separating the various collected substances which may include precipitates, particulates and gases from the emulsified mixture of the two fluids after the chemical, mineral and mechanical reactions therein have been completed. Following removal of the collected substances, the fluid mixture can be reclaimed, readjusted as to reactive components and reused in the venturi scrubber system of the invention.

The invention further relates to a system wherein the two fluids to be mixed in the venturi devices are introduced into a series of venturi devices which are arranged in a vertical cascade, with sufficient elevation between vertically spaced venturi devices such that the elevational head of the mixed, emulsified fluids from an upstream venturi deviced provides necessary pressure for operation of a subsequent venturi device.

2. State of the Art

It is well known that toxic matter, reactive gases and hazardous wastes are being discharged into the atmosphere, soils, oceans, ground waters and surface waters. Environmental agencies and others who are aware of the dangers these substances present are duly concerned about finding a safe and reliable way of disposing of the toxic materials. Safe and responsible management of municipal, industrial, agricultural, automotive and other wastes have become a priority issue. Previous attempts to provide safe and complete disposition of the wastes have resulted in partial or complete failure.

Exemplary U.S. patents which discuss various aspects of the art wherein venturi type devices and methods are employed include:

| | | |
|---|---|---|
| Thorp | U.S. Pat. No. 2,606,150 | August 5, 1952 |
| Valdespino | U.S. Pat. No. 3,271,304 | September 6, 1966 |
| Bowles | U.S. Pat. No. 3,467,121 | September 16, 1969 |
| McKenzie | U.S. Pat. No. 3,667,193 | June 6, 1972 |
| Dietrick | U.S. Pat. No. 3,707,067 | December 26, 1972 |
| Winn | U.S. Pat. No. 3,741,533 | June 26, 1973 |
| Hege | U.S. Pat. No. 3,820,759 | June 28, 1974 |
| Hall | U.S. Pat. No. 3,870,082 | March 11, 1975 |
| Hegemann | U.S. Pat. No. 4,375,439 | March 1, 1983 |

In addition, the following German patents also discuss venturi devices and methods of scrubbing gases with fluids by use of a venturi device:

| | | |
|---|---|---|
| Schimming | No. 44,164 | September 6, 1887 |
| Ott | No. 30,162 | June 1, 1907 |
| Dietrich | No. 908,904 | March 4, 1954 |

The prior art patents as listed above disclose various apparatus and methods of scrubbing a gas with a liquid such as water, using a venturi type device to mix the liquid and gas or of mixing one liquid with another wherein a venturi is used to draw the liquids together. The prior art chronicles the now well known methods of drawing a liquid or gas into a second liquid or gas by pressure differentials created at the throat of the venturi device.

Gas scrubbing of large volumes of gases with relatively small volumes of a liquid such as water have been suggested as shown by the listed prior art patents. However, the contact between the two fluids passing through the venturi device is relatively short lived. The prior art does not provide a venturi device which thoroughly encapsulates one fluid within the other in a near emulsion-like condition wherein the reactive components in the two fluids are maintained in contact in a condition susceptible to reaction for a time long enough to achieve such reaction.

The listed prior art further fails to disclose a system wherein the encapsulated, near emulsified fluid coming from an initial venturi device is fed as a collecting fluid in a subsequent venturi device to mix with and encapsulate additional collected fluid therein. Nor is there any suggestion in the listed prior art of conditioning the collecting fluid to contain reactive chemicals which will react with contaminating substances in the collected fluid wherein gaseous and fluid contaminants are converted to relatively nontoxic solids, liquids and gases which can be readily separated from the collected and collecting fluids, such that the collected and collecting fluids can be reused in various processes or released to the atmosphere without harmful effects to the atmosphere or other environments.

OBJECTIVES

A principal objective of the present invention is to provide a novel venturi mixer device having a flared impingement member upon which the combined collector fluid and collected fluid impinge immediately upon passing through the nozzle of the venturi device such that the combined effect of the venturi nozzle and impingement member is to thoroughly encapsulate the collected fluid within the collector fluid in a near emulsified condition thereby achieving initimate contact between the collector fluid and collected fluid for a relatively extended period of time.

An additional objective of the present invention is to provide such a venturi mixer device wherein the collected fluid is introduced to the venturi nozzle by feed conduit directed axially into the venturi nozzle, and means are further provided for adjustably positioning the downstream end of the feed conduit at any desired position between the inlet end and the outlet end of the venturi nozzle.

A further objective of the present invention is to provide a fluid contacting system comprising at least two such venturi mixer devices which are spaced by a preset vertical distance, and the near emulsified effluent from an upper venturi mixer device is utilized as the collector fluid in the next adjacent lower venturi device to collect and be intimately mixed with additional collected fluid in the next adjacent lower venturi device, wherein the pressure and the combined mass of the near emulsified fluid effluent from the upper venturi device, together with the increased volume of the fluid and the head pressure developed by the vertical spacing of the adjacent venturi devices provide the driving force for operation of the lower venturi device.

A still further objective of the present invention is to provide a method of scrubbing a collected fluid by a collector fluid utilizing a novel venturi mixer device in accordance with the invention and further wherein the collector fluid contains chemical constituents which are adapted to react with toxic contaminants in the collected fluid to convert the toxic contaminants into innocuous compounds which can be separated from the collected fluid.

It is yet another object of the present invention to provide a system and method wherein the mass, volume, and velocity of the two fluid streams delivered to a given venturi device are added to produce a near emulsified effluent from the venturi device with the combined weight, volume and velocity of the combined effluent from the upstream venturi device being delivered as the collector stream to one or more subsequent downstream venturi devices to produce additional vacuum in the subsequent venturi devices thereby drawing additional collected fluid into the collector stream, whereby each additionally employed venturi type devices serves to compound the mass, volume and velocity of the combined effluents from previously employed venturi type devices and thereby compound the intake rate or mixing of the collected fluid with the collector fluid.

A further object of the present invention is to provide a novel system and method for scrubbing a gas stream derived from combustion processes such that the produced gases, being predominantly carbon dioxide and inert nitrogen, wherein the combustion gases are contacted with an aqueous based scrubbing solution in venturi scrubbers in accordance with the present invention; and further wherein calcium-carbonate is employed to provide a source of bicarbonate in the scrubbing solution, whereby the solution will allow carbon dioxide to pass through the scrubbing solution to be released to the atmosphere along with the inert nitrogen gas, but wherein acid forming gases other than carbon dioxide are converted into liquid acids by reaction with the water content of the scrubbing solution and then converted into a calcium salt by chemical reaction with the calcium bicarbonate contained in the scrubbing solution.

It is an additional object of the present invention to provide an improved and novel scrubbing system and method in accordance with the invention wherein the near emulsion-like affluent from the venturi mixer devices is treated in processing means wherein liquid acids resulting from intimate contact between the acid forming gases and the aqueous based scrubbing solution are further converted into mineral precipitates, with the heavier than water precipitates released from the scrubbing solution and collected at the bottom part of the processing means, and the lighter than water precipitates are released from the scrubbing solution and collected at the top part of the processing means.

It is a specific object of the present invention to provide an improved and novel system and method for traveling the loaded scrubbing solution through such processing means in a manner that permits relatively nonturbulent flow of scrubbing solution therethrough such that the precipitates therein will respond to gravity and buoyancy forces wherein heavier than water and lighter than water substances are separated from the scrubbing solution.

It is a further object of the present invention to provide pump and/or fan means to deliver the collector fluid as well as the collected fluid to the venturi mixer devices under pressure to thereby increase the volume of fluids being treated by a substantial amount.

It is a still further object of the present invention to provide an improved and novel system and method for combining the various aspects of the present invention such that the combination thereof provides vacuum assistance to the pressure force being applied to the collected fluid as it passes through the venturi devices; adjustable venturi action; elevated introduction of the collector and collecting fluids; flow through emulsification; progressively compounded increase in mass of the collector fluid; progressively compounded increase in volume of the collector fluid; progressively compound increase in velocity of the collector fluid; progressively compounded increase in vacuum produced by subsequent venturi devices in a series of such devices; continuous re-emulsification of the mixed fluids into a circulating fluid slurry; chemical and/or physical classification of the reacted substances contained in the circulating fluid slurry; separation of the reacted substances from the circulating fluid slurry; continuous restructuring of the circulating fluid slurry by means of adjusting the chemical composition; and complete processing capability of collecting, reacting and separating toxic and hazardous substances from fluids including gases, vapors, and liquids containing such toxic and hazardous substances.

SUMMARY OF THE INVENTION

The above objectives and other advantages of the invention are achieved in accordance with the present invention by providing a system for collecting, scrubbing, emulsifying, reacting, separating and circulating a collector fluid and a collecting fluid. The fluids can be gases or liquids. The collector fluid is preferably an aqueous solution, and the collected fluid can be a liquid or gas containing suspended or dissolved contaminants. In a particularly preferred embodiment the collected fluid is a mixture of gases containing gases and vaporized liquids as well as solids as soluble and/or finely divided solids, or any combination thereof. In particular, the system includes a novel venturi mixer device into which is introduced under pressure a collector fluid. A collected fluid is drawn into the venturi device. and intimately mixed with the collector fluid in the venturi mixer device or a series of such devices. The venturi mixer devices are adjustable, with the feed conduit delivering the collected fluid into the venturi nozzles of the venturi mixer devices being adjustably positioned with respect to the venturi nozzle. It is advantageous to determine the positioning of the feed conduit to produce the greatest degree of vacuum in relation to the volume and velocity of the collector and collected fluids. When the adjustment setting is determined to be the most advantageous, the feed conduit is set to maintain such setting for as long as is desired. If a change in composition or rates of input from either of the fluid sources occurs, the vacuum being produced is altered. The feed conduit can then be re-adjusted to suit the changed conditions.

The venturi mixer devices are preferably arranged in vertically spaced cascade, with sufficient elevation between vertically spaced venturi devices such that the elevational head of the mixed, emulsified fluids from an upstream venturi provides necessary pressure for operation of the subsequent downstream venturi device. The resulting increase in mass, volume and velocity of the effluent from an upstream venturi device provides for the operation of one or more downstream venturi devices, such that such downstream venturi devices have either increased capacities or two or more such devices are operated from the effluent from an upstream venturi device. Generally, the increased mass, volume and head pressure from an effluent stream from an upstream venturi will operate two lower disposed venturi devices. The collapse of water vapor and carbon dioxide gas from gaseous collected streams containing water vapor and carbon dioxide gas (due to condensation of the water vapor and formation of carbonic acid by the carbon dioxide gas) substantially adds to the vacuum being produced by the venturi device. This increase in vacuum due to water condensation and carbonic acid formation as each additional venturi type device is employed, is additive to the vacuum that is being generated by the venturi device. This progressive increase of vacuum is repeated as often as is required to introduce the total volume of the collected fluid into the total volume of the collecting fluid.

Each venturi device is provided with an impingement member upon which the total flow of the collector fluid and collected fluid impinge as the combined fluids pass from the nozzle of the venturi device. The impingement member achieves exceptional blending and mixing of the two fluids to an extent that the effluent is a homogeneous, single stream being an emulsion or nearly an emulsion even when the collected fluid is a gas. Reactive constituents of the collected fluid are brought into intimate contact with the collector fluid and any reactive chemicals contained by the collector fluid. Intimate contact is maintained for a substantial time rather than being momentary. Under such circumstances sufficient contact time is provided for all reactive components to react and for acid forming gases in the collected fluid to be converted into liquid acids by intimate contact with the aqueous collector fluid. All liquid acids so formed are preferably further reacted with chemicals and minerals in the collector fluid to further be converted into salts. When combustion gases are being treated, the predominant gas, carbon dioxide, is allowed to pass through the collector fluid and released to the atmosphere. All other reactive gases are reacted by the contact with the reactive chemicals contained in the collector fluid. Amorphous carbon particulates are saturated with water during this process.

Apparatus is provided for conducting the flow of combined and near emulsified stream of collector fluid and collected fluid coming from a venturi device and delivering the effluent stream to the next vertically spaced venturi device whereby the mixing and emulsifying action of the previous venturi device is repeated, and the vacuum developed in the subsequent venturi is utilized to draw in additional collected fluid to be mixed into a near emulsion condition with the effluent from the previous venturi device.

In a preferred embodiment of the invention, the system is provided with apparatus for processing and separating the effluent stream from the last and lowermost positioned venturi device or devices to separate various components of the effluent and to continue the circulation of the resulting fluid to the uppermost venturi as reconditioned collector fluid. The chemical composition of the recirculated collector fluid is advantageously adjusted as needed to maintain its proper collecting and reacting capabilities. The apparatus for processing and separating the effluent from the lowermost venturi devices comprises a settling chamber having a series of baffle plates which direct lighter components such as nitrogen gas and other nontoxic gases and light liquids to the upper side of the separating apparatus wherein the lighter components can be withdrawn. Heavier liquids and solids are directed downwardly by gravity to the bottom of the separating device for recovery. The unloaded fluid from the central portion of the separating apparatus is withdrawn and recirculated as reconditioned collector fluid.

Additional objects and features of the present invention will become apparent from the following detailed description, taken together with the accompanying drawings.

THE DRAWINGS

Preferred embodiments of the present invention representing the best mode presently contemplated of carrying out the invention are illustrated in the accompanying drawings in which FIG. 1 is a schematic representation of a collecting, mixing and separating system in accordance with the present invention;

Figure 1:
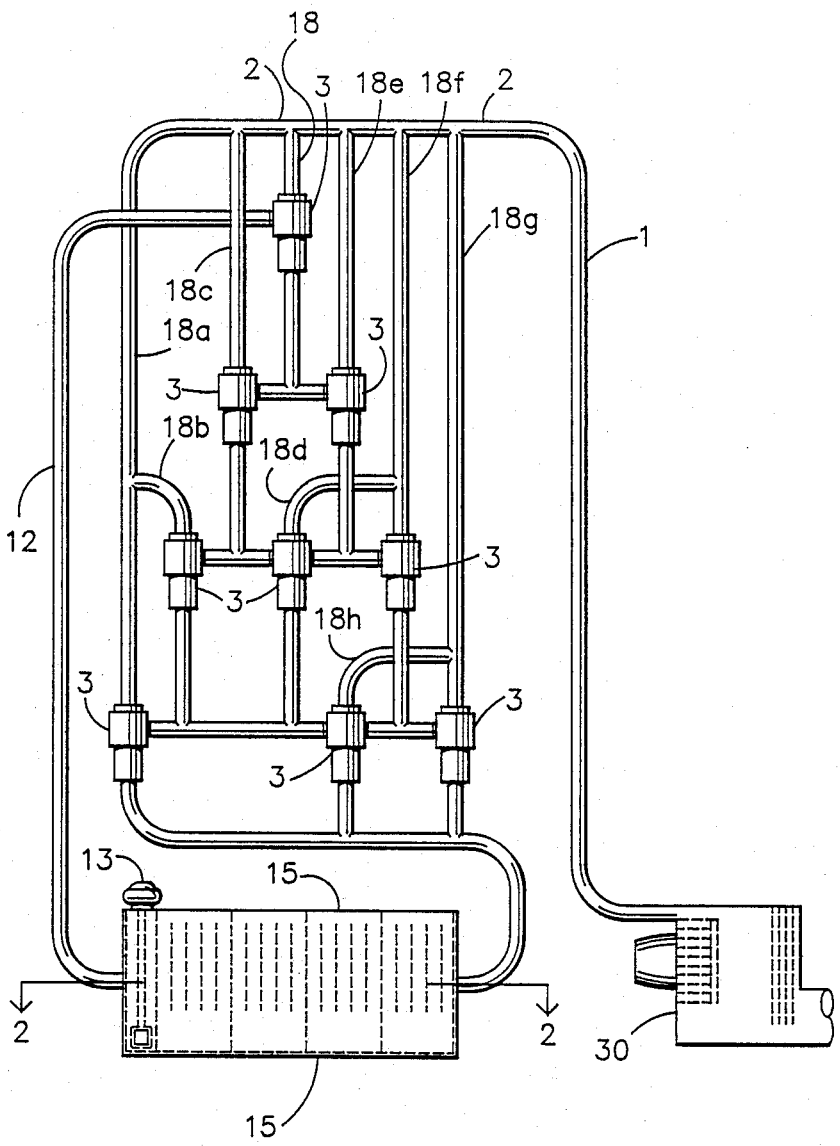
Figure 2:
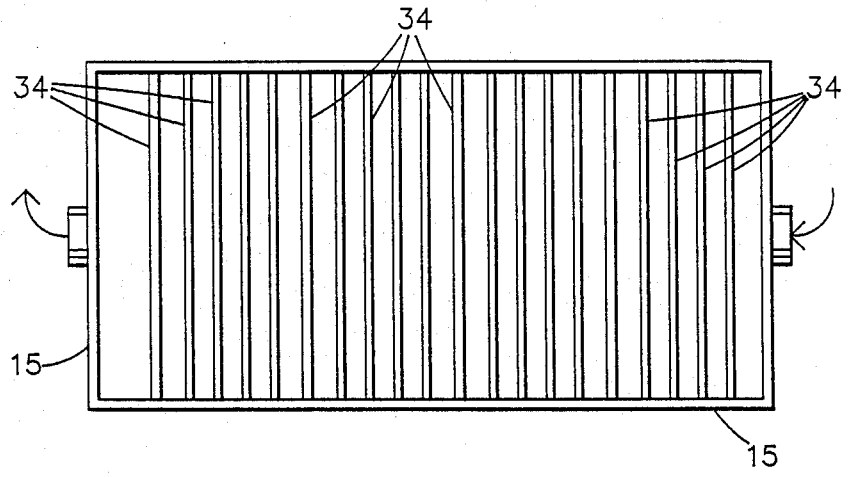
FIG. 2 is a horizontal, cross-sectional view of the processing and separation means 15 of FIG. 1 taken along line 2—2 of FIG. 1.
Figure 3:
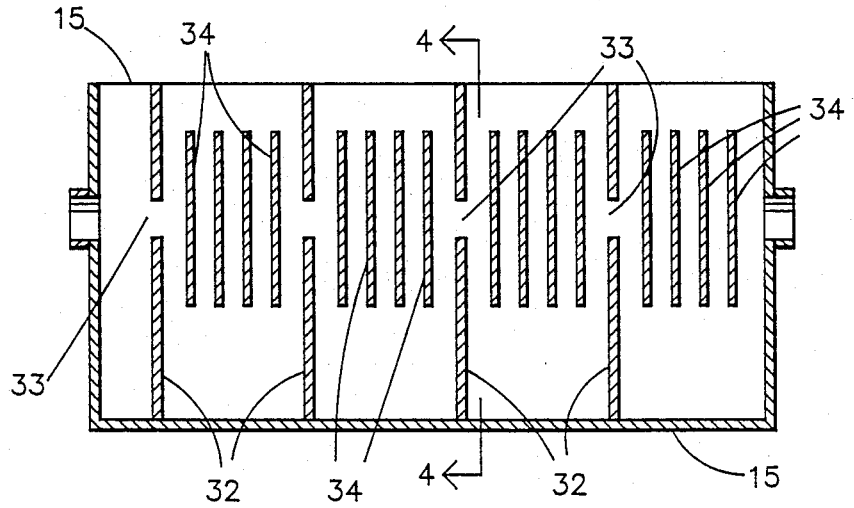
FIG. 3 is a vertical, cross-sectional view of the processing and separation means 15 of FIG. 1 taken along line 3—3 of FIG. 2.
Figure 4:
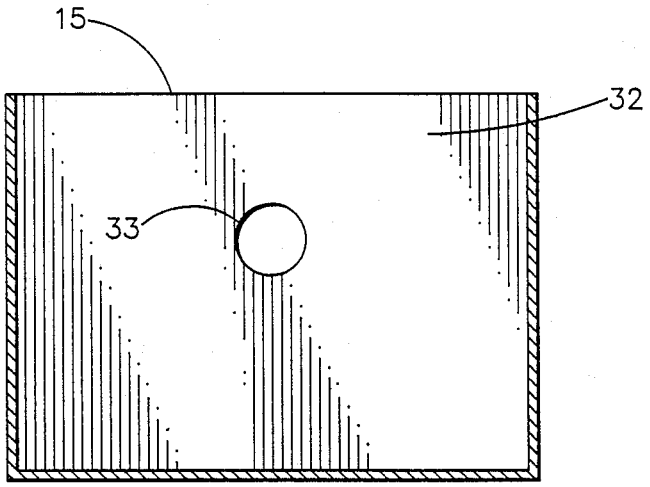
Figure 5:
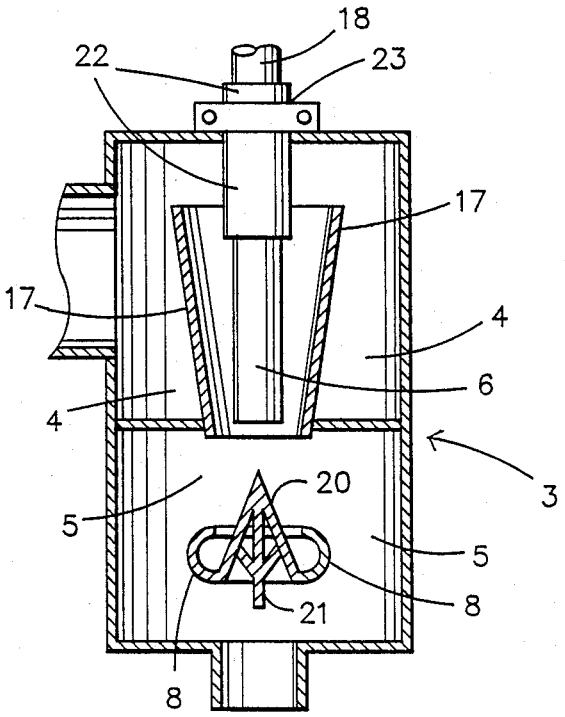

FIG. 4 is a transverse, cross-sectional view of the processing and separation means 15 of FIG. 1 taken along the line 4—4 of FIG. 3; and FIG. 5 is a schematic, vertical cross-sectional view of the adjustable venturi mixing device 3 of FIG. 1 showing the impingement member positioned immediately below the nozzle of the venturi.

DETAILED DESCRIPTION OF THE ILLUSTRATED EMBODIMENTS

Referring to FIG. 1, there is shown one preferred embodiment of a collecting, mixing, processing and separating system in accordance with the present invention. The system is used for scrubbing, cleaning and processing a fluid containing udesirable, toxic contaminants. The contaminated fluid will be referred to many times throughout this disclosure as the collected fluid inasmuch as it is collected and intimately mixed with a collector fluid (a scrubbing medium) in the system of the present invention. The collected fluid can be gaseous, a mixture of gases and vapors, a liquid, a mixture of gases, vapors and liquids and a combination of any of the proceeding components further including dispersed solids. The system of the present invention is particularly adapted to collect the collected fluid and intimately mix the collected fluid with a collector fluid. The contaminants in the collected fluid react with reactive components of the collect fluid to convert the contaminants into non-toxic components which can be removed from the fluid. The contaminants in the collected fluid can be poisonous, hazardous, toxic and otherwise harmful substances in the form of gases, liquids, vapors, suspended solids and mixtures thereof derived from various sources such as emissions originating from industrial, commercial, municipal, automotive and other sources.

The elements of the system include a fan or pump 30 for introducing the fluid to be collected, under pressure, and through the transport conduit 1 and the manifold 2 into the draft pipe 18 and, optionally, into the draft pipes 18*a*, 18*b*, 18*c*, 18*d*, 18*e*, 18*f*, 18*g* and 18*h* of venturi mixing devices 3. The draft pipe 18 and the optional draft pipes 18*a* through 18*h* are each adjustably mounted to respective venturi mixer devices 3 by adjustable mounting members 22 and collars 23 as shown in FIG. 5.

As best shown in FIG. 5, the venturi devices 3 comprises a first flow channel 4 and means for introducing the collector fluid under pressure into the first flow channel 4 to produce a suction vacuum by the flow of the collector fluid through the nozzle or cone 17 of the venturi device 3. The nozzle or cone 17 has a preset volume, an inlet end and an outlet end. The inlet end and the outlet end are interconnected by an elongate sidewall, with the transverse, cross section of the sidewall uniformly decreasing in a direction from the inlet end to the outlet end of the nozzle or cone 17. The inlet end of the nozzle or cone 17 is in flow communication with the first flow channel 4 of the venturi device 3 for flow of the collector fluid from the first flow channel 4 to the nozzle or cone 17.

The venturi device 3 further comprises an expansion chamber 5 which has an inlet end and an outlet end. The inlet end of the expansion chamber 5 is in flow communication with the outlet end of the nozzle or cone 17. The expansion chamber 5 has a volume which is greater than the volume of the nozzle or cone 17 to allow expansion of the fluids flowing from the nozzle or cone 17 into the expansion chamber 5. A feed conduit 6 comprising the distal end of a draft pipe 18 extends downwardly substantially axially in line with the nozzle or cone 17. The downstream end of the feed conduit 6 is adjustably positioned to extend no further than the outlet end of the nozzle or cone 17. The mounting member 22 and collar 23 provide adjustment means for adjustably positioning the downstream end of the feed conduit 6 at any desired position between the inlet end and outlet end of the nozzle or cone 17.

As the collector fluid travels through the nozzle or cone 17 and past the terminal end of the feed conduit 6, a vacuum or decreased pressure is produced by the flow through the nozzle or cone 17. The reduced pressure near the terminal end of the feed conduit 6 draws the collected fluid into the stream of collector fluid passing through the nozzle or cone 17. The feed conduit 6 is preferentially adjusted with respect to its location in the nozzle or cone 17 so as to produce the greatest reduction in pressure at the terminal end of the feed conduit 6. The feed conduit is then secured in its adjusted position by the collar 23. The reduced pressure at the terminal end of the feed conduit 6 works together with the pressure in the draft pipe 18 developed by the pump or fan 30 to impel the collected fluid into the stream of collector fluid passing through the nozzle or cone 17. The feed conduit 6 is preferentially adjusted with respect to its location in the nozzle or cone 17 so as to produce the greatest reduction in pressure at the terminal end of the feed conduit 6. The feed conduit is then secured in its adjusted position by the collar 23. The reduced pressure at the terminal end of the feed conduit 6 works together with the pressure in the draft pipe 18 developed by the pump or fan 30 to impel the collected fluid into the stream of collector fluid.

The mixed streams of collector fluid and collected fluid pass from the end of the nozzle or cone 17 into the expansion chamber 5. An impingement member 20 having a substantially pointed, closed, upstream end and an expanded downstream end is mounted within the expansion chamber 5 by a support bracket 21. The pointed upstream end of the impingement member 20 is positioned adjacent to the outlet end of the nozzle or cone 17. The mixed stream of collector and collected fluids passing from the end of the nozzle or cone 17 immediately impinge upon the outwardly flared sidewall of the impingement member 20. The mixed streams are forcefully mixed into a near emulsion by the impingement on the impingement member. To increase the emulsifying action, the impingement member 20 is preferably further provided with an upwardly and outwardly curved flange 8 extending around the entire perimeter of the flared, downstream end of the impingement member 20. The curved flange 8 directs the flow of mixed collector and collected fluids back upon itself so as to very effectively increase the emulsifying action of the impingement member 20. As illustrated, the nozzle 17 preferably has the shape of an inverted, truncated cone, and the impingement member 20 has the shape of a cone, with the impingement member 20 being located coaxially beneath the nozzle 17.

The system of scrubbing and cleaning a second fluid with a first fluid in accordance with the present invention preferably comprises a plurality of venturi mixer devices 3 arranged in a cascade. The initial venturi mixer device 3 in the cascade is elevated to a preset elevation; with the remaining venturi mixer devices 3 being arranged in vertically spaced tiers or positions in the cascade. The second tier will have at least one venturi mixer device 3 and can advantageously support two such devices as shown in FIG. 1.

Means are provided for transporting the effluent mixture of the first and second fluids coming from the initial venturi mixer device 3 to the vertically spaced, downstream, intermediate venturi mixer devices 3 in the cascade thereof, with the effluent mixture from the initial venturi mixer device 3 being introduced as the first fluid in the subsequent downstream venturi mixer devices to mix with additional second fluid in that next subsequent venturi mixer device 3. As shown in FIG. 1, the volume increase in mixed fluids coming from the initial venturi mixer device 3 and the vertical elevation between the initial venturi device 3 and the next subsequent venturi mixer device 3 cooperate to provide sufficient drive force to operate a pair of such venturi mixer devices 3 in the second tier.

Means are also provide for transporting the effluent mixtures of first and second fluids coming from the respective intermediate venturi mixer devices 3 to additional, vertically spaced, downstream venturi mixer devices 3 in the cascade thereof when such additional devices are used. In any event, means are provided for transporting the effluent mixtures of first and second fluids coming from the lowermost venturi mixer devices 3 in the cascade to a settling chamber 15. As shown in FIG. 1, thereof an additional third tier of venturi mixer devices 3 located below the second tier, and a final, fourth tier of venturi mixer devices 3 located below the third tier. As illustrated, the third and fourth tiers each contain three venturi mixer devices 3.

The combined downstream flow of mixed first and second fluids from the lowermost venturi mixer devices 3 are transported by appropriate means to a settling chamber 15 wherein the intimately mixed fluids are allowed to separate into light components, intermediate fluid components and heavy components.

Referring to FIGS. 1–4, a preferred embodiment of the settling chamber 15 is illustrated as being rectangular with the top part of the chamber 15 being open to the atmosphere or to optional hoods and ventilating apparatus. The interior of the chamber 15 is shown as comprising a series of processing sub-chambers. An inlet to the settling chamber 15 is provided at a point near the center of the inlet end thereof. This inlet is connected to the means for transporting the effluent mixture from the last employed venturi mixer devices 3 to the settling chamber 15.

The processing sub-chambers of the settling chamber 15 are delineated by the longitudinally spaced bulkheads 32. The openings allow fluids to flow from one sub-chamber to the next. A series of baffle plates 34 are provided in each sub-chamber, with the plates 34 extending transversely from one side of the settling chamber 15 to the other side thereof and cross-wise to the forward flow of fluid through the sub-chamber. Fluid flows over the tops and under the bottoms of the processing plates 34.

The processing plates 34 are preferably equally spaced between the inlet and the outlet of each sub-chamber. The processing plates 34 are so positioned in the flow stream that the fluid flow is equally divided as it is travelled both over and under the processing plates 34. The spaced plates 34 provide area that are free of forward stream travel wherein the components of the fluid may migrate in response to gravitational changes and travel therethrough either upward or downward as heavier and lighter substances and reacted precipitates are released from the fluid mixture. Equipment for the removal of accrued heavy substances from the facility 15 is not included in the invention. The heavy matter collecting at the bottom of the chamber 15 can be removed by manual operation or other means well known in chemical handling technology.

As the flow of fluid passes through the settling chamber 15, the entire collected burden is released and the liquid is readjusted in its composition as required. The circulating fluid is withdrawn from the settling chamber 15 and pumped through the conduit 12 by the circulating pump 13 to continue the cycle.

Although preferred embodiments of apparatus and methods in accordance with the present invention have been illustrated and described, it is to be understood that the present disclosure is made by way of example and that various other embodiments are possible without departing from the subject matter coming within the scope of the following claims, which subject matter is regarded as the invention.

I claim:

1. A venturi mixer device for intimately mixing and contacting first and second fluids for purposes of scrubbing and cleaning one of the fluids with the other, said venturi mixer device comprising a first flow channel;

means for introducing a first fluid into said first flow channel;

a nozzle of a preset volume, said nozzle having an inlet end, an outlet end and a transverse, cross section which decreases in a direction from said inlet end to said outlet end, with the inlet end connected in flow communication with said first flow channel for flow of said first fluid from said first flow channel to said nozzle;

an expansion chamber having an inlet end and a outlet end, with the inlet end being in flow communication with the outlet end of said nozzle, said expansion chamber further having a volume which is greater than the volume of said nozzle;

an impingement member having a substantially pointed upstream end and an expanded downstream end, said impingement member being mounted within said expansion chamber, with the upstream end of said impingement member being positioned adjacent to the outlet end of said nozzle, said impingement member further having a flared sidewall which diverges outwardly in a direction toward the expanded downstream end of said impingement member;

a feed conduit extending substantially axially in line with said nozzle, said feed conduit having a downstream end which extends no further than the outlet end of said nozzle;

means for introducing a second fluid into said feed conduit; and means for withdrawing the initimately mixed first and second fluids as an effluent from the outlet end of said expansion chamber.

2. A venturi mixer device in accordance with claim 1, wherein the downstream end of said impingement member is further provided with an upwardly and outwardly curved flange extending around the entire perimeter of the downstream end of said impingement member.

3. A venturi mixer device in accordance with claim 1, wherein the nozzle has the shape of an inverted, truncated cone, and the impingement member has the shape of a cone, with the impingement member being located coaxially beneath the nozzle.

4. A venturi mixer device in accordance with claim 3, wherein the downstream end of said impingement member is further provided with an upwardly and outwardly curved flange extending around the entire perimeter of the downstream end of said impingement member.

5. A venturi mixer device in accordance with claim 1, wherein means are provided for adjusting the position of the downstream end of said feed conduit at any desired spacing between the inlet end and outlet end of said nozzle.

6. A venturi mixer device in accordance with claim 1, wherein there is further provided means for feeding said first fluid to said first flow channel under pressure.

7. A venturi mixer device in accordance with claim 1, wherein there is further provided means for feeding said second fluid to said feed conduit under pressure.

8. A system for scrubbing and cleaning a second fluid with a first fluid, said system comprising at least one venturi mixer device in accordance with claim 1 for intimately mixing and contacting the first fluid with the second fluid;

a settling chamber wherein the intimately mixed fluids are allowed to separate into light components, intermediate fluid components and heavy components;

means for transporting the intimately mixed first and second fluids from the venturi mixer device to said settling chamber;

means for withdrawing the intermediate fluid from said settling chamber and delivering the withdrawn intermediate fluid under pressure to said venturi mixer device as said first fluid.

9. A system for scrubbing and cleaning a second fluid with a first fluid in accordance with claim 8, wherein means are also provided for adding reactive substances to the first fluid being introduced into said venturi mixer, with the reactive substances being adapted to react with toxic contaminants in said second fluid during the intimate contact between the first and second fluids.

10. A system for scrubbing and cleaning a second fluid with a first fluid in accordance with claim 8, wherein a plurality of venturi mixer devices are provided with the initial venturi mixer device being elevated to a preset elevation and with the remaining venturi mixer devices being arranged in vertically spaced positions in a cascade;

means for transporting the effluent mixture of first and second fluids coming from the initial venturi mixer device to at least one vertically spaced, downstream, intermediate venturi mixer device in the cascade thereof, with the effluent mixture from said initial venturi mixer device being introduced as the first fluid in the subsequent downstream venturi mixer device to mix with additional second fluid in that next subsequent venturi mixer device;

means for transporting the effluent mixtures of first and second fluids coming from respective intermediate venturi mixer devices to at least one respective, vertically spaced, downstream venturi mixer device in the cascade thereof, with the effluent mixture being introduced as the first fluid in the next subsequent downstream venturi mixer device to mix with additional second fluid in that venturi mixer; and means for transporting the effluent mixtures of first and second fluids coming from the respective lowermost venturi mixer devices to said settling chamber.

11. A method for intimately mixing and contacting first and second fluids for purposes of scrubbing and cleaning one of the fluids with the other, said method comprising flowing a first fluid under pressure through a nozzle of a first venturi mixer device, said nozzle having an inlet end, an outlet end and a transverse, cross section which decreases in a direction from said inlet end to said outlet end;

inducing a second fluid to flow through the nozzle of said first venturi mixer device and to mix with said first fluid as the fluid passes from said nozzle of said first venturi mixer device;

impinging the mixed flow of first and second fluids against an impingement member to form a homogeneous mixture of said first and second fluids, wherein said impingement member has a substantially pointed upstream end and an expanded downstream end, with said impingement member being positioned adjacent to the outlet end of said nozzle, said impingement member further having a flared sidewall which diverges outwardly in a direction toward the expanded downstream end of said impingement member; and withdrawing the mixed flow of first and second fluids from said first venturi mixer device.

12. A method in accordance with claim 11, wherein the effluent mixture from said first venturi mixer device is transported to a settling chamber in which light and heavy components of the mixture are separated from an intermediate fluid component, and the intermediate fluid component is recirculated under pressure as said first fluid to flow through the nozzle of said first venturi mixer device.

13. A method in accordance with claim 11, wherein reactive agents are added to said first fluid prior to flowing the first fluid through the nozzle of said first venturi mixer device, said reactive agents being adapted to react with specific components of said second fluid as said second fluid is mixed with said first fluid.

14. A method in accordance with claim 11, wherein the mixed effluent from said first venturi mixer device is transported downwardly in a conduit from said first venturi mixer device;

the mixed effluent is made to flow through a subsequent nozzle of a second venturi mixer device, said subsequent nozzle having an inlet end, an outlet end and a transverse, cross section which decreases in a direction from said inlet end to said outlet end, with said second venturi mixer device being spaced a vertical distance from said first venturi mixer device;

inducing additional second fluid to flow through said subsequent nozzle of the second venturi mixer device to mix with the mixed effluent fluids from said first venturi mixer device as the mixed effluent passes from said subsequent nozzle of said second venturi mixer device;

impinging the mixed flow of fluids in said second venturi mixer device against a second impingement member to form a homogeneous mixture of first and second fluids, wherein said second impingement member has a substantially pointed upstream end and an expanded downstream end, with said second impingement member being positioned adjacent to the outlet end of said subsequent nozzle of said second venturi mixer device, said second impingement member further having a flared sidewall which diverges outwardly in a direction toward the expanded downstream end of said second impingement member; and withdrawing the mixed flow of first and second fluids from said second venturi mixer device.

15. A method in accordance with claim 14, wherein the effluent mixture from said second venturi mixer device is transported to a settling chamber in which light and heavy components of the mixture are separated from an intermediate fluid component, and the intermediate fluid component is recirculated under pressure as said first fluid to flow through the nozzle of said first venturi mixer device.

16. A method in accordance with claim 14, wherein reactive agents are added to said first fluid prior to flowing the first fluid through the nozzle of said first venturi mixer device, said reactive agents being adapted to react with specific components of said second fluid as said second fluid is mixed with said first fluid.

17. A method in accordance with claim 14, wherein the effluent from said second venturi mixer device is transported downwardly in a conduit from said second venturi mixer device to mix with additional second fluid in at least one subsequent, downstream venturi mixer device.

18. A method in accordance with claim 17, wherein the effluent mixture from the last downstream venturi mixer device of said subsequent venturi mixer devices is transported to a settling chamber in which light and heavy components of the mixture are separated from an intermediate fluid component, and the intermediate fluid component is recirculated under pressure as said first fluid to flow through the nozzle of said first venturi mixer device.

19. A method in accordance with claim 17, wherein reactive agents are added to said first fluid prior to flowing the first fluid through the nozzle of said first venturi mixer device, said reactive agents being adapted to react with specific components of said second fluid as said second fluid is mixed with said first fluid.

* * * * *